US011247215B2

(12) United States Patent
Kühnert et al.

(10) Patent No.: US 11,247,215 B2
(45) Date of Patent: Feb. 15, 2022

(54) CENTRIFUGE AND SWING BUCKET ROTOR

(71) Applicant: Eppendorf AG, Hamburg (DE)

(72) Inventors: Steffen Kühnert, Leipzig (DE); Heinz Gerhard Köhn, Hamburg (DE)

(73) Assignee: Eppendorf AG, Hamburg (DE)

( * ) Notice: Subject to any disclaimer, the term of this patent is extended or adjusted under 35 U.S.C. 154(b) by 588 days.

(21) Appl. No.: 16/191,942

(22) Filed: Nov. 15, 2018

(65) Prior Publication Data

US 2019/0143341 A1 May 16, 2019

(30) Foreign Application Priority Data

Nov. 16, 2017 (DE) ..... 10 2017 127 039.6

(51) Int. Cl.
*B04B 5/04* (2006.01)
*B04B 11/04* (2006.01)

(52) U.S. Cl.
CPC ..... *B04B 5/0421* (2013.01); *B04B 2011/046* (2013.01)

(58) Field of Classification Search
CPC ..... B04B 5/0421; B04B 2011/046
USPC ..... 494/16, 20
See application file for complete search history.

(56) References Cited

U.S. PATENT DOCUMENTS

| | | | | |
|---|---|---|---|---|
| 3,028,075 | A * | 4/1962 | Blum | B04B 5/0421 494/20 |
| 3,377,021 | A | 4/1968 | Fox et al. | |
| 3,687,359 | A | 8/1972 | Scanlon | |
| 4,344,563 | A | 8/1982 | Romanauskas | |
| 4,400,166 | A | 8/1983 | Chulay et al. | |
| 4,435,168 | A * | 3/1984 | Kennedy | B04B 5/0421 494/20 |
| 9,757,739 | B2 * | 9/2017 | Sato | B04B 5/0421 |
| 2012/0190527 | A1 * | 7/2012 | Nemoto | B04B 5/0421 494/33 |
| 2015/0114123 | A1 | 4/2015 | Schaefer et al. | |
| 2016/0121342 | A1 | 5/2016 | Sato et al. | |
| 2016/0214118 | A1 | 7/2016 | Sato et al. | |

FOREIGN PATENT DOCUMENTS

| | | | |
|---|---|---|---|
| CN | 105562219 | A | 5/2016 |
| DE | 102006027680 | A1 | 12/2007 |
| EP | 0054744 | A2 | 6/1982 |
| JP | S4833059 | | 10/1973 |
| JP | S5632029 | A | 4/1981 |
| JP | S56032029 | B | 7/1981 |
| JP | 2009510399 | A | 3/2009 |
| JP | 2016087483 | A | 5/2016 |
| JP | 2016137457 | A | 8/2016 |

* cited by examiner

*Primary Examiner* — Walter D. Griffin
*Assistant Examiner* — Shuyi S. Liu
(74) *Attorney, Agent, or Firm* — Smartpat PLC

(57) ABSTRACT

A centrifuge includes a swing rotor. Rotor arms of the swing rotor have recesses into which hangers of the swing rotor at least partially swing in a swung-out state. As a result, the centrifuge container and thus also the centrifuges are more compact, because the swinging-out requires less space. An inertial mass of the swing rotor is reduced due to the recesses provided therein, whereby energy consumption, primarily when starting the centrifuge, is significantly reduced.

18 Claims, 7 Drawing Sheets

CENTRIFUGE AND SWING BUCKET ROTOR

TECHNICAL FIELD

The present disclosure relates to a swing bucket centrifuge and to a rotor of a swing bucket centrifuge.

BACKGROUND

Centrifuge rotors are used in centrifuges, in particular laboratory centrifuges, to separate the components of samples centrifuged therein based on their density. Ever higher rotational speeds are used to achieve high separation rates. Laboratory centrifuges are centrifuges whose rotors operate at preferably at least 3,000, preferably at least 10,000, in particular at least 15,000 revolutions per minute and are usually placed on tables. In order to place them on a work table, they may have a form factor of less than 1 m×1 m×1 m; their space is therefore limited. Preferably, the depth of the device is limited to a maximum of 70 cm.

Such centrifuges are used in the fields of medicine, pharmacy, biology and chemistry and the like.

In most cases, it is provided that the samples are centrifuged at certain temperatures. For example, samples that contain proteins and similar organic substances may not be overheated, so the upper limit for tempering such samples is normally in the range of +40° C. On the other hand, certain samples are normally cooled in the range+4° C. (the anomaly of the water starts at 3.98° C.).

In addition to such predetermined maximum temperatures of, for example, about +40° C. and standard examination temperatures such as +4° C., further standard examination temperatures are also provided, such as at +11° C., in order to check at this temperature whether the refrigeration system of the centrifuge is running regulated below room temperature. On the other hand, it is necessary for occupational safety reasons to prevent touching of elements which have a temperature of greater than or equal to +60° C.

In principle, active and passive systems can be used for temperature control. Active cooling systems have a coolant circuit to influence the temperature of the centrifuge container, thereby indirectly cooling the centrifuge rotor and the sample containers accommodated therein.

Passive systems are based on exhaust-assisted cooling or ventilation. This air is conducted directly past the centrifuge rotor, whereby a temperature control takes place. In this case, the air is sucked through openings in the centrifuge vessel, wherein the suction takes place automatically through the rotation of the centrifuge rotor.

The samples to be centrifuged are stored in sample containers and these sample containers are driven in a rotatory manner by means of a centrifuge rotor. The centrifuge rotors are usually set into rotation by means of a vertical drive shaft which is driven in a rotatory manner by an electric motor. Various centrifuge rotors are used, depending on the application. The sample containers may contain the samples directly or individual sample receptacles, which contain the sample, are used in the sample containers, so that a plurality of samples can be centrifuged simultaneously in a sample container.

Centrifugal rotors in the form of fixed-angle rotors and swing rotors are generally known.

If the sample vessels are arranged at a fixed predetermined angle in the centrifuge rotor, then it is a so-called fixed-angle rotor. Such fixed angle rotors usually have a lower part and a lid, wherein in the closed state of the lid, an inner space is formed between the lower part and the lid, in which inner space the sample vessels can be arranged to centrifuge the samples in a suitable centrifuge.

In contrast to this, it is a swing rotor when there is at least one hanger in the centrifuge rotor that can swing out from a vertical position to a horizontal position depending on the rotary speed of the centrifuge rotor. The hanger is mounted on a rotor base body and able to swing out. Such hangers are usually configured as centrifuge buckets. However, also known are hangers in which the sample container itself is provided with corresponding coupling means for coupling with the centrifuge rotor and is thus held able to swing out in the centrifuge rotor. In the context of the present invention, "hanger" is therefore understood to mean not only a receptacle for sample containers, but also a sample container mounted able to swing out. The present disclosure is based on such swing rotors.

For connection to the centrifuge, the swing rotor is usually provided with a hub which can be coupled to the motor-driven drive shaft of the centrifuge. The hangers of the swing rotor usually have a lower part, which is closed by a lid. The lid of the hanger is normally configured closable with the lower part. However, there are also known hangers that have no lid.

Usually, an aerosol-tight seal is provided between the lid and the lower part. The aerosol-tight seal allows the hanger to be easily transported and manipulated without the risk of the samples being able to contaminate the centrifuge or the environment. The closure between lid and lower part can be configured differently.

A disadvantage of such swing rotors is that they take up a relatively large space due to the swinging of the hanger occurring during swinging out, so that the centrifuges used for centrifuging must be dimensioned relatively large compared to fixed angle rotors.

It is therefore an object of the present disclosure to design the swing rotor so that this disadvantage is reduced. An improved swing rotor with the same loading capacity, that is, with the same amount of sample to be accommodated, should require less space than known rotors. Preferably, an improved centrifuge provided with the new swing rotor should be smaller than an equivalent known centrifuge. If of equal size, the improved centrifuge should accommodate a larger amount of sample than an equivalent known centrifuge.

SUMMARY

This object is achieved with an improved swing rotor for a centrifuge that has a rotor base body with rotor arms. A rotor hub is provided for coupling the swing rotor to a drive. Hangers, in particular buckets, are mounted to the rotor arms so as to swing out between two of the rotor arms. The rotor arms have recesses into which the buckets and/or sample containers stored therein swing into in a swung-out state. An improved centrifuge uses the improved swing rotor.

The inventors recognized, that a swing rotor for a centrifuge can be improved in a surprisingly simple manner by providing recesses in the swing rotor, into which at least parts of the hanger and/or sample containers mounted therein can swing when the hanger swings out. As a result, the swing rotor can be designed significantly more compact with the same loading capacity of the hanger. In this context, it may be provided that regions of the lid, regions of the lower part, or both regions of the lower part and the lid swing into the recesses when swinging out.

The improved centrifuge, which is in particular a laboratory centrifuge, comprises a swing rotor driven by drive means, which swing rotor has one or more hangers, preferably buckets, and a rotor hub for coupling with the drive means. The hanger is mounted able to swing out between two rotor arms of a rotor body, and is characterized by the fact that the rotor arms have recesses which the hanger and/or sample containers stored therein at least partially swing into in the swung-out state.

In an advantageous embodiment, it is provided that the recesses are configured as grooves, in particular as flutings. They can be then be particularly easily introduced in the swing rotor, for example, in the context of a forming process during manufacturing of the rotor base body.

In an advantageous embodiment, it is provided that the recesses are formed rounded. As a result, only a slightest possible recess is required for the sliding in of the hanger.

In an advantageous embodiment, it is provided that the recesses extend over a length of the rotor arm, which is shorter than the distance between the rotor hub and mounting of the hanger. The stability of the swing rotor is then guaranteed even at the threshold.

In an advantageous embodiment, it is provided that the recesses extend over a height of the rotor arm, which is less than the height of the rotor arm at the location of the recess, wherein the recesses are bounded in particular by upper and lower webs. Then the stability of the swing rotor is guaranteed even at the threshold.

In an advantageous embodiment, it is provided that two recesses arranged on different sides of a rotor arm are connected by a through hole. For example, the connected recesses may have the cross-sectional shape of a diabolo having a central passage. As a result, the compactness and mass reduction of the swing rotor can be further improved.

In an advantageous embodiment, it is provided that rotor arms are configured at the location of the recess with a smaller cross-section than in regions without a recess. As a result, the inertial mass of the swing rotor is reduced, which reduces the energy requirement when starting the centrifuging.

In an advantageous embodiment, it is provided that the recesses cover a region of the rotor arms which corresponds to half the distance between the axis of rotation of the swing rotor and the mounting of the hanger with respect to the radius of the swing rotor. The swing rotor is then particularly compact.

In an advantageous embodiment, it is provided that the swing rotor has at least three, preferably at least four, rotor arms for at least three, preferably at least four hangers mounted between them. Of course, five or more rotor arms may be provided in order to mount a like number of hangers able to swing out between them.

An improved swing rotor for a centrifuge, which is drivable by a drive means of a centrifuge, has one or more hangers, preferably buckets, and a rotor hub for coupling with the drive means. The hanger is mounted able to swing out between two rotor arms of a rotor base body, and is characterized in that the rotor arms have recesses which the hanger and/or sample containers stored therein at least partially swing into in the swung-out state.

The following detailed description of the invention is merely exemplary in nature and is not intended to limit the invention or the application and uses of the invention. Furthermore, there is no intention to be bound by any theory presented in the preceding background of the invention or the following detailed description of the invention.

DETAILED DESCRIPTION

Figure 1:
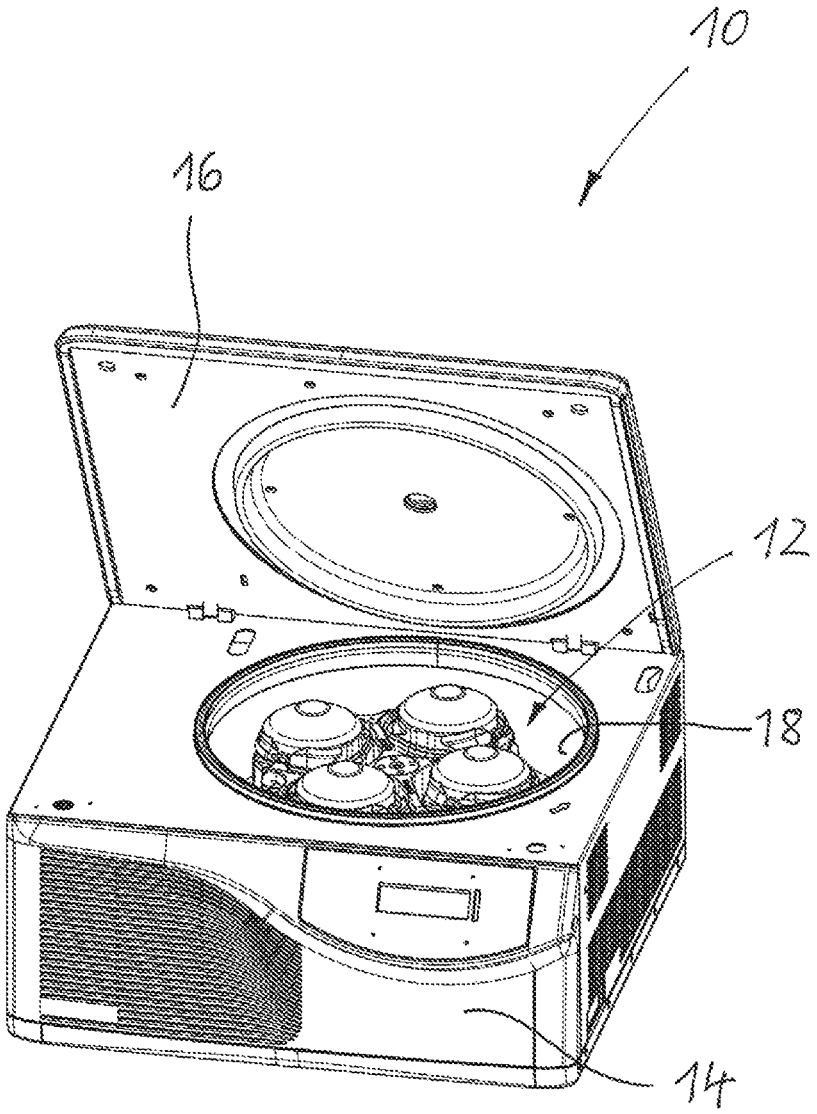
FIG. 1 is a perspective view of a centrifuge.
Figure 2:
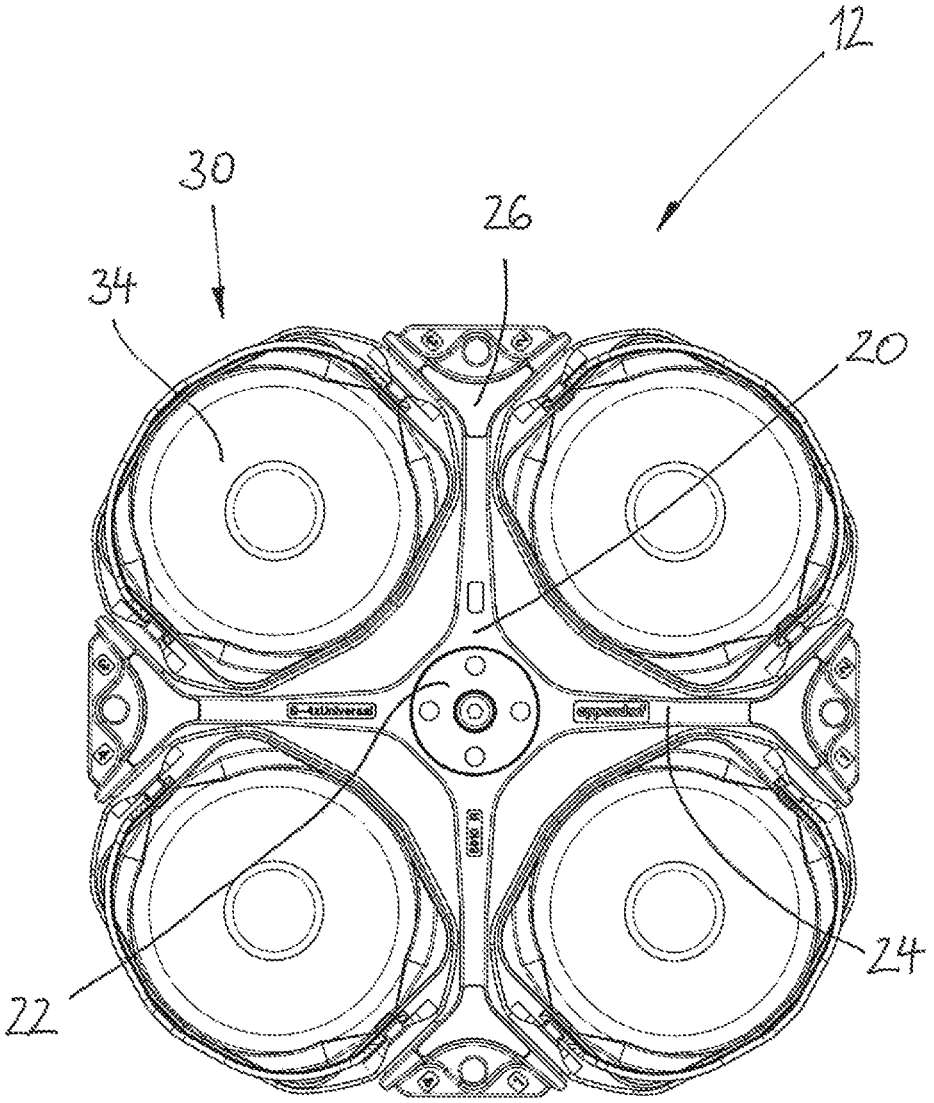
FIG. 2 is a top view of a swing rotor for the centrifuge as in FIG. 1 in a non-swung-out state of the hangers.

FIGS. 1 to 5 show a first example of a centrifuge 10 with a swing rotor 12 inserted therein.

The centrifuge 10 is configured as a laboratory centrifuge, which has a housing 14 with a lid 16. In the centrifuge container 18 of the centrifuge 10, the swing rotor 12 is arranged on a drive shaft (not shown) of a centrifuge motor (not shown).

The swing rotor 12 has a rotor base body 20 having a hub 22 which is coupled via screws 23 with the drive shaft. The rotor base body 20 has four rotor arms 24, which are each arranged on the hub 22 offset in the circumferential direction 90° to each other. The rotor arms 24 open into arm branches 26, at each of which two retaining pins 28 are arranged. Oppositely arranged retaining pins 28, 28' of two oppositely arranged arm branches 26, 26' are aligned so that they lie in a line and thus form a swing-out axis A.

Hangers 30 are configured as a bucket 32 and provided with lids 34. In these buckets 32, samples are accommodated in sample containers or sample carriers. The sample containers or sample carriers are optionally arranged in adapters (all not shown). The samples can be centrifuged with the aid of the centrifuge 10.

The hangers 30 have pin receivers 36 which have an upper stop 38 and two lateral guides 40. The hangers 30 can be arranged on the retaining pins 28 with the help of these pin receivers 36. In this case, the upper stops 38 rest on the retaining pins 28 and the lateral guides 40. Together with a configuration of the pin receivers 36 matching the shape of the retaining pins 28, they form a pivot bearing 41 about the swing-out axis A, so that the hangers 30 can swing out from a non-swung-out position shown in FIG. 2 into a swung-out position shown in FIG. 3 around the swing-out axis A.

The non-swung-out position, in which the hanger longitudinal axis L extends parallel to an axis of rotation D of the swing rotor 12, is assumed by the hanger 30 during standstill of the swing rotor 12. The swung-out position, in which the hanger longitudinal axis L extends approximately perpendicular to the axis of rotation D of the swing rotor 12, is assumed by the hanger 30 during a sufficiently high rotary speed during operation of the swing rotor 12.

The rotor arms 24 have, starting from the hub 22, a slightly conically tapered cross-section, wherein the thickness B is constant over the entire height H, except for the regions in which the recesses 42 are provided. The thickness B' is significantly reduced there, as can be seen particularly well in FIG. 5. These recesses 42 extend over a region which is half-way between the swing-out axis A and the axis of rotation D in relation to the radius of the swing rotor 12.

Figure 3:
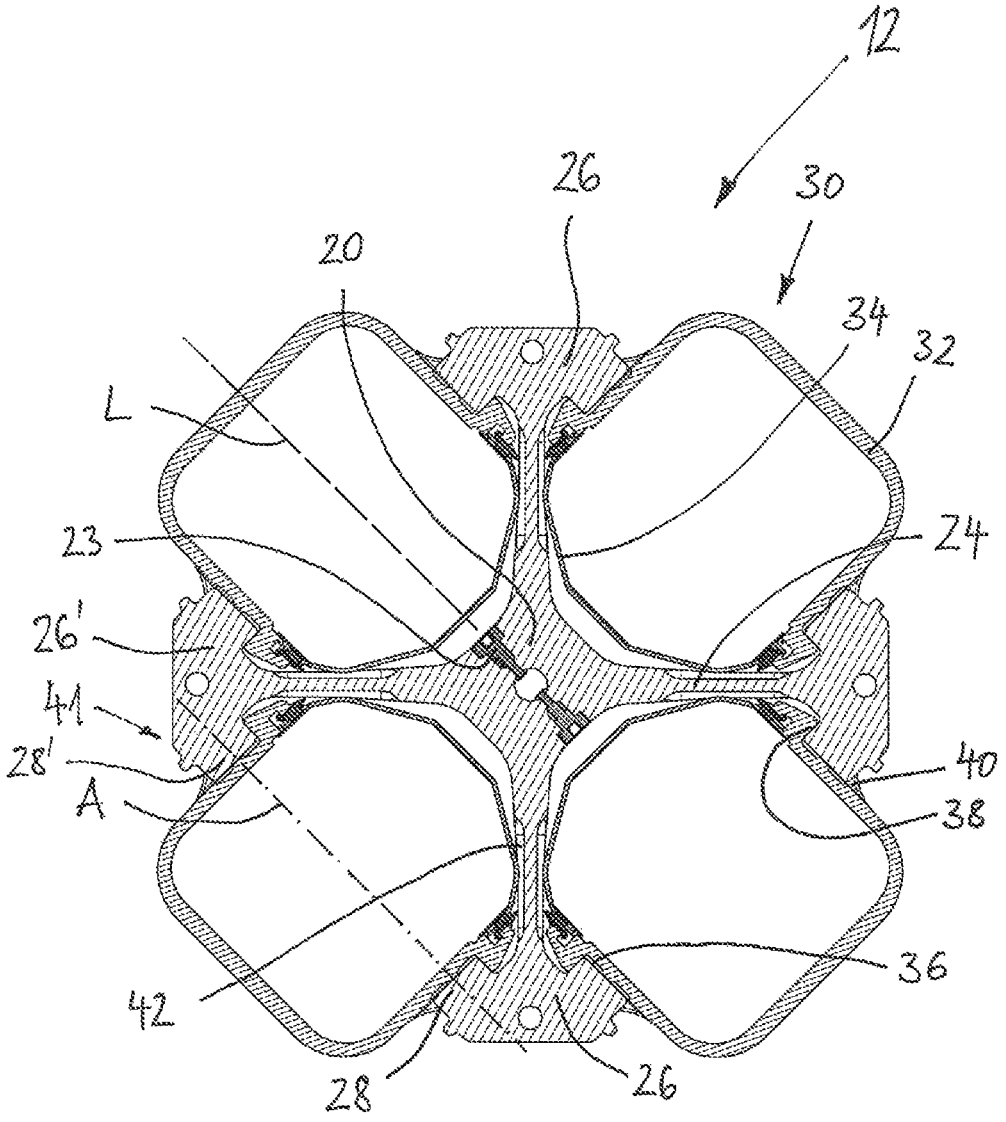
FIG. 3 is a cross sectional view showing the swing rotor as in FIG. 2 in a swung-out state of the hangers.
Figure 4:
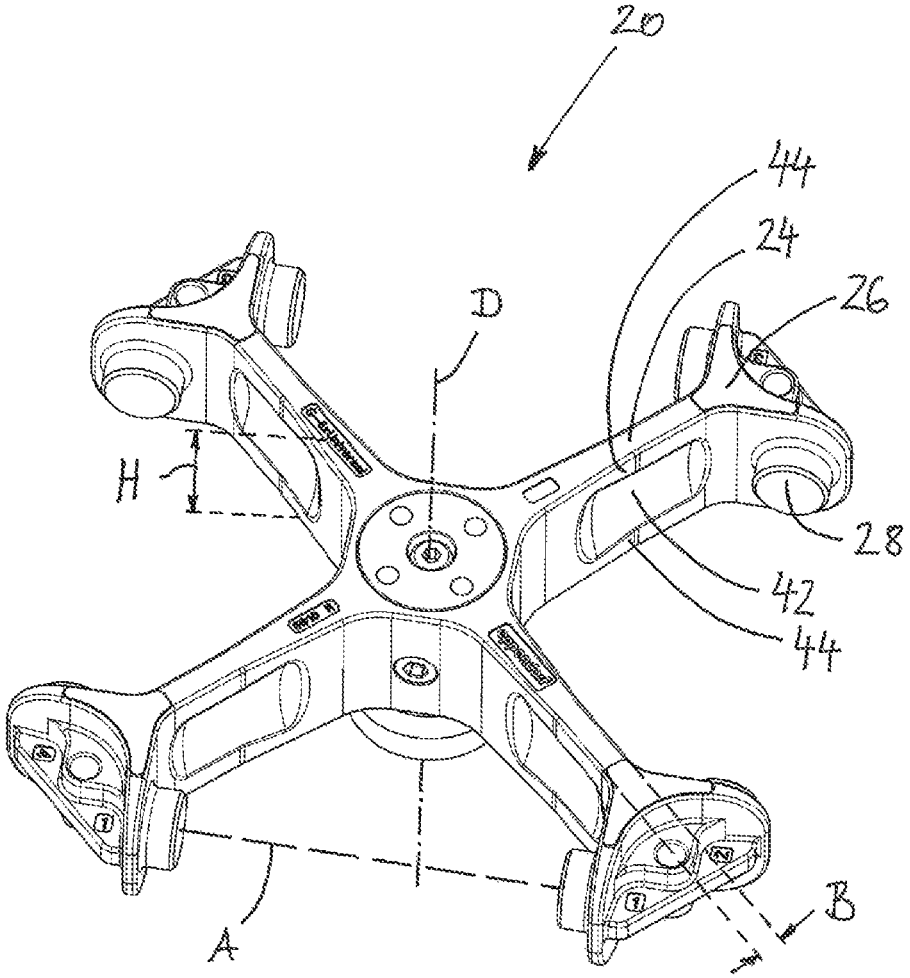
FIG. 4 is a perspective view of a rotor base body of the swing rotor as in FIG. 2.
Figure 5:
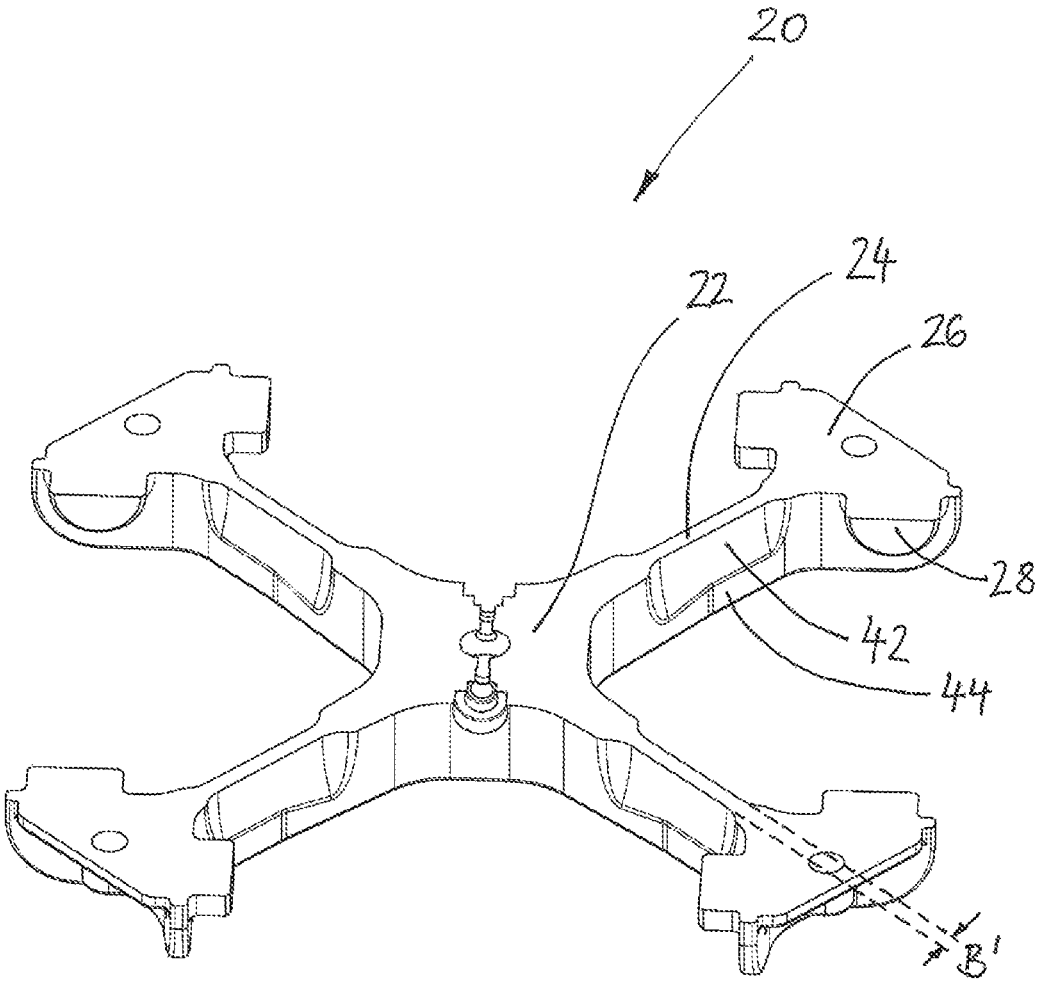
FIG. 5 is a perspective sectional view of the rotor base body shown in FIG. 4.

The recesses 42 are configured fluted and rounded and the lid 34 of the bucket 32 can swing into them in the swung-out state, as can be seen in FIG. 3.

Due to the fact that the recesses 42 are bounded above and below by webs 44, a high rigidity and stability remains ensured despite the subtraction of material, even at high rotary speeds of the swing rotor 12.

Numerous advantages are achieved through this particular embodiment of the swing rotor 12 having recesses 42 into which the hangers 30 can swing.

On the one hand, the swing-out axes A can be brought closer to the axis of rotation D with identical hangers 30. As a result, the centrifuge container 18 and thus also the centrifuges 10 can be designed essentially more compact, because the swinging-out now requires less space.

On the other hand, instead of a more compact design of the centrifuges 10, the dimensioning of both the centrifuge container 18 and the rotor base body 20 can be maintained and instead the hanger 30 can be enlarged, so that a larger amount of sample can be centrifuged.

In addition, a reduction of the inertial mass of the swing rotor 12 is related to the recesses 42, whereby the energy consumption, primarily when starting the centrifuge 10, is significantly reduced.

As shown, the lid 34 of the hanger 30 swings into the recess 42 in the described embodiment. Alternatively, the swing rotor 12 can also be designed so that the bucket 32 alone or the bucket 32 and lid 34 can swing into the recess together.

Figure 6:
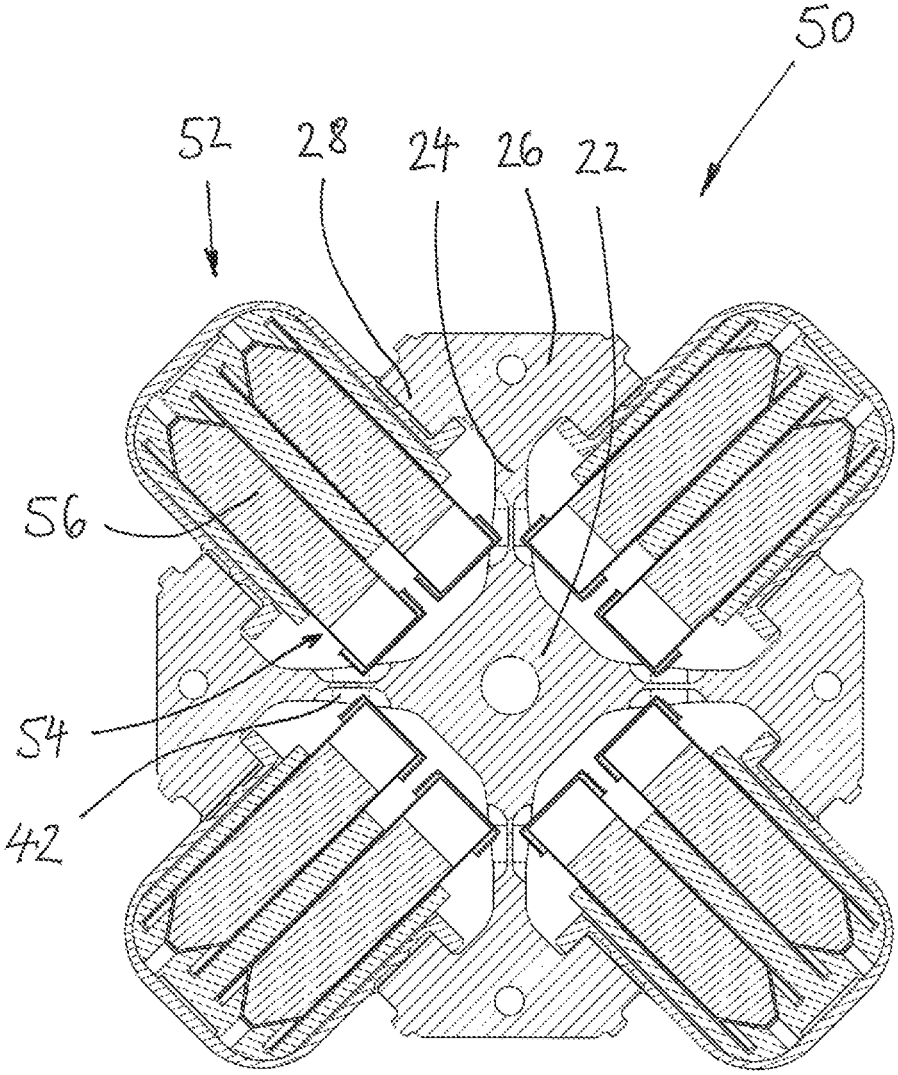
FIG. 6 is a sectional view showing an alternative embodiment of a swing rotor in a swung-out state of the hangers.
Figure 7:
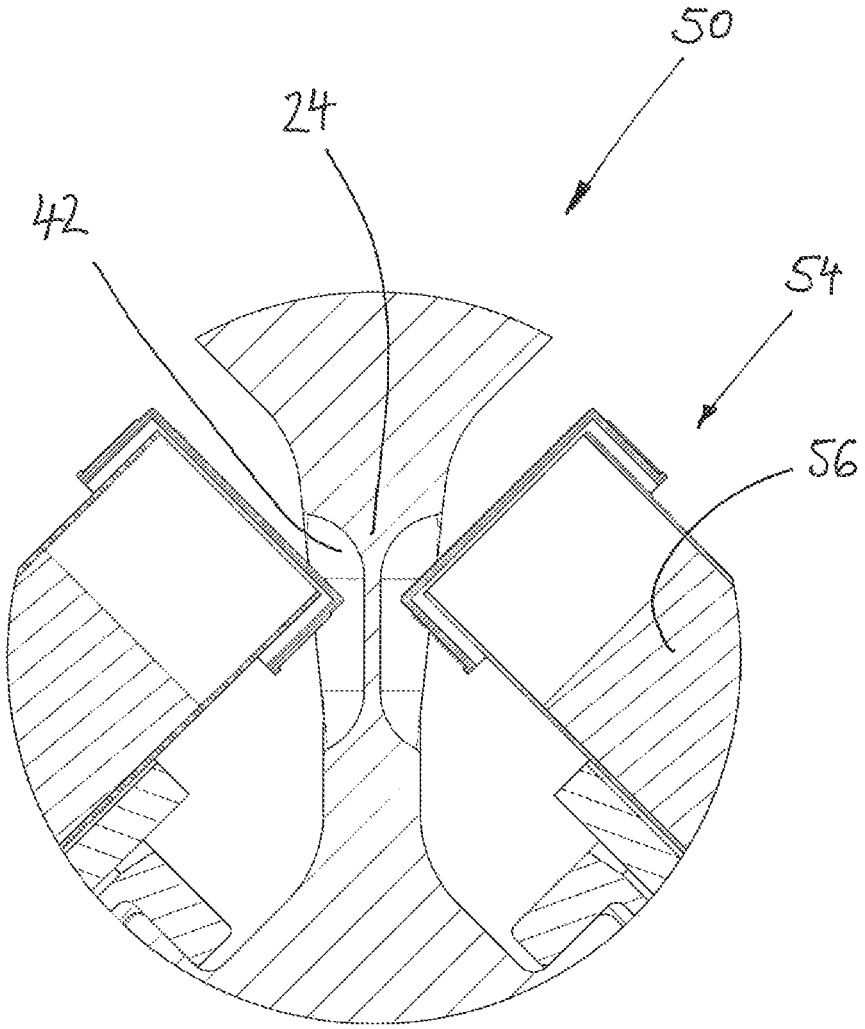
FIG. 7 is a detail view of the swing rotor shown in FIG. 6 illustrating sample containers sliding into recesses.

On the other hand, in a second preferred embodiment of the swing rotor 50, it is shown that the hanger 52 itself does not have to swing into the recess 42. It can also be provided that a sample container 54 arranged in the hanger 52, in which sample container a sample 56 is located, swings into this recess 42 when swinging out, as can be seen in FIG. 6 and the relevant detail view corresponding to FIG. 7. Even then, the space is made more compact.

From the above description, it has become clear that a centrifuge 10 and a swing rotor 12, 50 are provided, with which the space within the centrifuge 10 can be used significantly better.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. A centrifuge, comprising:

a swing rotor, the swing rotor having a rotor base body with rotor arms that open into arm branches at outer ends, and are connected to a rotor hub at inner ends for coupling the swing rotor to a drive; and hangers mounted so as to swing out between two of the rotor arms, the rotor arms having recesses into which the hangers and/or sample containers stored therein swing into in a swung-out state, wherein two retaining pins are arranged on each of the arm branches and wherein the hangers include pin receivers matching the retaining pins, the pin receivers and the retaining pins jointly forming pivot bearings, and wherein the recesses extend along the rotor arms between their inner ends and their outer ends at a distance from the pivot bearings, and wherein the recesses cover a region of the rotor arms which, with respect to a radius of the swing rotor, is located half-way between an axis of rotation of the swing rotor and a mounting of the hangers.

2. The centrifuge according to claim 1, wherein the hangers are buckets which are provided with lids, and wherein the lids swing into the recesses when the hangers are in the swung-out state.

3. The centrifuge according to claim 1, wherein the recesses are configured as grooves.

4. The centrifuge according to claim 1, wherein the recesses have a rounded cross-sectional shape and wherein the recesses cover a region of the rotor arms that is radially half way between an axis of rotation of the swing rotor and an axis of rotation of the pivot bearings.

5. The centrifuge according to claim 1, wherein the recesses extend over a length along the rotor arms which is shorter than a distance between the rotor hub and a mounting of the hangers.

6. The centrifuge according to claim 1, wherein the recesses extend over a height across the rotor arms which is smaller than a height of the rotor arms at the recesses, and wherein the recesses are bounded by upper and lower webs.

7. The centrifuge according to claim 1, wherein two recesses arranged on different sides of the rotor arms are connected by a through hole.

8. The centrifuge according to claim 1, wherein the rotor arms have a smaller cross sectional thickness at a location of the recesses than in regions outside the recesses.

9. The centrifuge according to claim 1, wherein the swing rotor has at least three of the rotor arms and at least three of the hangers mounted between the at least three rotor arms.

10. The centrifuge according to claim 1, wherein the swing rotor has four of the rotor arms and four of the hangers mounted between the four rotor arms.

11. A swing rotor for a centrifuge, comprising:

a rotor base body with rotor arms that open into arm branches;

a rotor hub for coupling the swing rotor to a drive;

two retaining pins arranged on each of the arm branches; and buckets mounted so as to swing out between two of the rotor arms, wherein the buckets include pin receivers matching the retaining pins, the pin receivers and the retaining pins jointly forming pivot bearings, wherein the rotor arms have recesses into which the buckets and/or sample containers stored therein swing into in a swung-out state, the recesses being arranged at a distance from the pivot bearings, and wherein the recesses cover a region of the rotor arms which, with respect to a radius of the swing rotor, is located half-way between an axis of rotation of the swing rotor and a mounting of the buckets.

12. The swing rotor according to claim 11, wherein the recesses are grooves.

13. The swing rotor according to claim 11, wherein the recesses extend over a length along the rotor arms which is shorter than a distance between the rotor hub and a mounting of the buckets.

14. The swing rotor according to claim 11, wherein the recesses extend over a height across the rotor arms which is smaller than a height of the rotor arms at the recesses, and wherein the recesses are bounded by upper and lower webs.

15. The swing rotor according to claim 11, wherein two recesses arranged on different sides of the rotor arms are connected by a through hole.

16. The swing rotor according to claim 11, wherein the rotor arms have a smaller cross sectional thickness at a location of the recesses than in regions outside the recesses.

17. The swing rotor according to claim 11, wherein the swing rotor has at least three of the rotor arms and at least three of the buckets mounted between the at least three rotor arms.

18. The swing rotor according to claim 11, wherein the swing rotor has four of the rotor arms and four of the buckets mounted between the four rotor arms.

* * * * *